United States Patent [19]

De Lepeleire

[11] 4,116,271

[45] Sep. 26, 1978

[54] COUNTER-CURRENT BUMPED PLATES HEAT EXCHANGER

[76] Inventor: Guido Amandus De Lepeleire, Waverse baan, 178, B-3030 Heverlee, Belgium

[21] Appl. No.: 723,368

[22] Filed: Sep. 15, 1976

Related U.S. Application Data

[63] Continuation of Ser. No. 547,068, Feb. 4, 1975, abandoned.

[51] Int. Cl.[2] ..... F28F 3/00

[52] U.S. Cl. ..... 165/166

[58] Field of Search ..... 165/165, 166, 157

[56] References Cited

U.S. PATENT DOCUMENTS

| | | | |
|---|---|---|---|
| 1,825,498 | 9/1931 | Wagan | 165/165 X |
| 2,813,701 | 11/1957 | Fenges | 165/165 X |
| 3,216,495 | 11/1965 | Johnson | 165/166 |

FOREIGN PATENT DOCUMENTS

| | | | |
|---|---|---|---|
| 1,099 of | 1878 | United Kingdom | 165/166 |

*Primary Examiner*—Charles J. Myhre
*Assistant Examiner*—Theophil W. Streule, Jr.
*Attorney, Agent, or Firm*—Sughrue, Rothwell, Mion, Zinn and Macpeak

[57] ABSTRACT

A counter current heat exchanger is comprised of a plurality of spaced parallel plates located in a rectilinear housing which closes the spaces along two opposed sides and provides a plurality of rows of spaced apertures along the other two sides with the apertures in alternate rows being offset from each other. Primary inlet and outlet collectors are secured to the apertured sides of the housing and have a zig-zag configuration to define parallel portions which have a triangular configuration. Alternate spaces in the collectors communicate with alternate rows of apertures. A rectilinear wall surrounds the primary collectors to define second collectors on opposite sides of the triangular primary collectors.

2 Claims, 18 Drawing Figures

FIG. 12
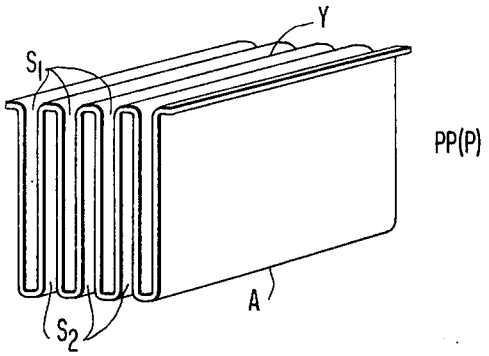
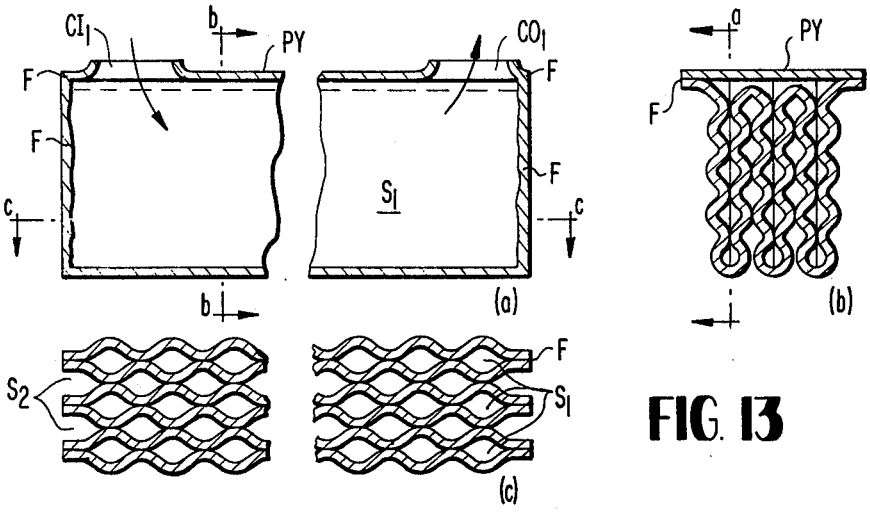
FIG. 13
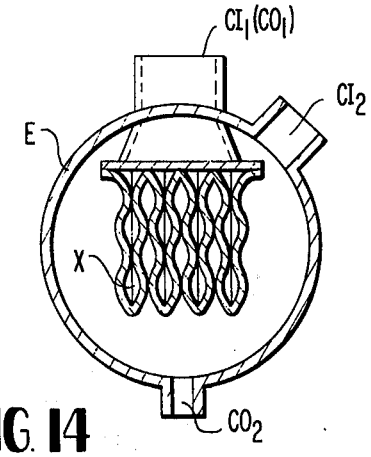
FIG. 14
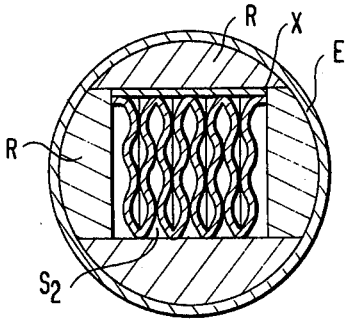
FIG. 15

FIG. 16
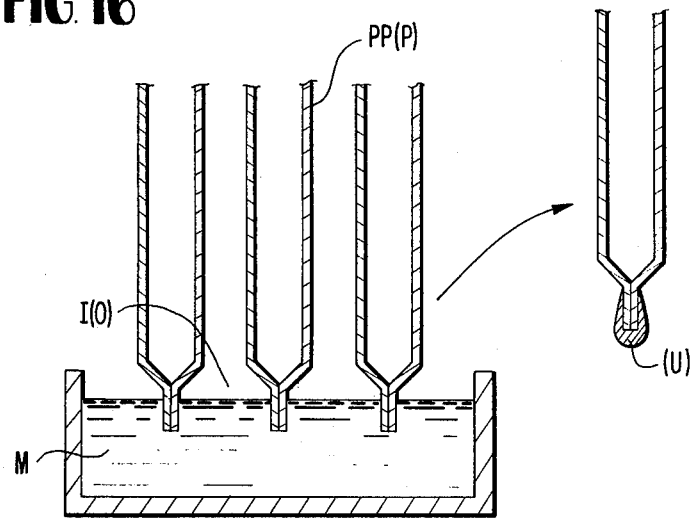
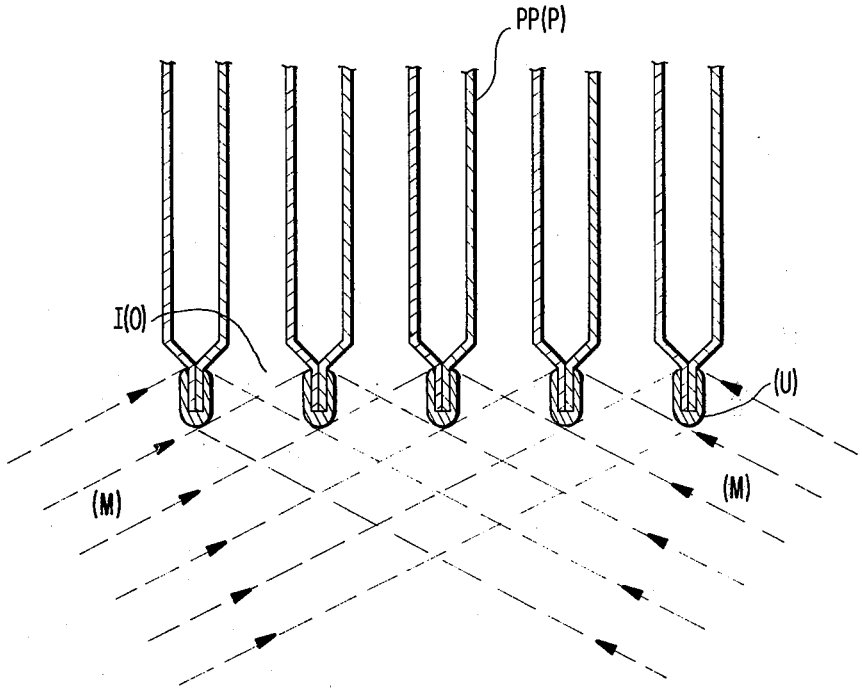
FIG. 17

COUNTER-CURRENT BUMPED PLATES HEAT EXCHANGER

This is a continuation of application Ser. No. 547,068, filed Feb. 4, 1975, now abandoned.

BACKGROUND OF THE INVENTION

1. Field of the Invention

This invention relates to plate heat exchangers and also to particular applications of the same.

2. Description of the Prior Art

In a general way heat exchangers are known with very different designs, according to a variety of functional necessities.

In the art of plate heat exchangers there are dismountable ones, made of a stack of corrugated plates, with hermetic gaskets around their periphery which maintain a suitable gap between the said plates.

Heat exchangers with fixed corrugated plates mounted in a housing with spacers and fixed for example by glueing, are also known. The corrugations cause turbulence in the fluid flow, which giving structural rigidity at the same time.

The prior art also includes pocket shaped heat exchangers made of rigid plates with spacers, fixed by soldering for example. Well known are the plate heat exchangers with primary and secondary surfaces made as an assembly of flat metallic sheets. In such heat exchangers, pressed sheets act as spacers and as secondary heat exchanging fins, and the assembly is finished by soldering or brazing.

Furthermore, different designs of heat exchanger plates have been described in specialized literature. Up to now they have not come into general use, probably due to problems subsisting in connection with assembly and fluid collection.

SUMMARY OF THE INVENTION

A heat exchanger according to the present invention is characterized by the special geometry and the particular way of assembling of pressed plates, which together make a compact, rigid heat exchanger, having only primary heat exchanging surfaces and in which counter-current operation is achieved by means of special fluid collectors, as is explained in the following text and associated figures.

DETAILED DESCRIPTION OF THE PREFERRED EMBODIMENTS

To build a heat exchanger conforming to the present invention, one can use - among other things - pressed sheets, including bumps or dents, systematically shaped and located in a suitable pattern, and protruding on one or on both sides of the said sheets. Different designs of dents and bumps can be used, some examples of which are illustrated in the first FIGS., 1 and 2.

When a number of similar, for example rectangular, pressed plates PP are assembled with the edges in suitable alignment, the successive plates touching and supporting each other by the said bumps, one achieves a rectangular assembly A offering, between the successive plates pp relatively narrow flow paths S. With a suitable positioning of the bumps as described above, a fluid can circulate and spread in all directions in each of the flow paths S between successive plates PP.

Figure 7:
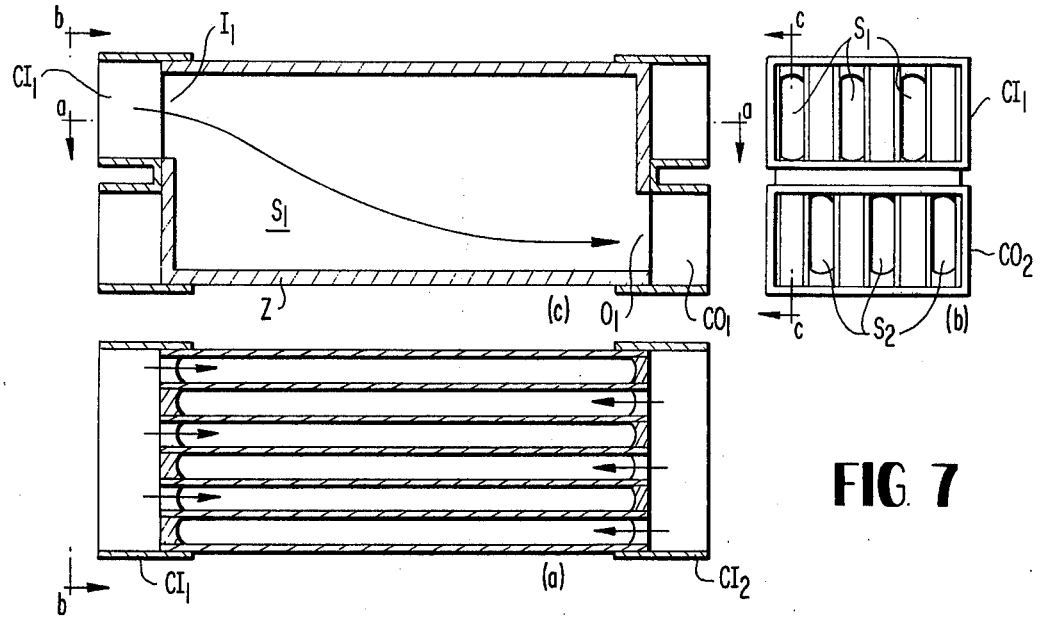

Obviously one should control the actual fluid flow, by partial stopping of the peripheral zone Z of the said flow path S, i.e., the zone close to the edges of the plates. In that case, the fluid cannot enter nor leave the flow path except in non stopped or closed places. For example, as shown in FIG. 7, one can seal the periphery of a first flow path $S_1$, except in two distinct places, where there are inlet and outlet orifices $I_1$, $O_1$. A circulating fluid necessarily goes from the entry to the exit, from $I_1$ to $O_1$, in between the fluid circulates according to lowest resistance, thus spreading over the available cross section. Doing the same for all of the odd flow paths $S_1$ of a plates assembly A, the inlet and outlet orifices $I_1$ and $O_1$ being similarly located each time, their orifices are in alignment and can easily communicate with inlet and outlet fluid collectors $CI_1$ and $CO_1$.

Similarly, one can partially seal the peripheral zones of the even flow paths $S_2$, inlet and outlet orifices $I_2$ and $O_2$ being located in order to communicate with inlet and outlet collectors $CI_2$ and $CO_2$, different from but close to the foregoing ones $CI_1$ and $CO_1$. With a relatively long heat exchanger as illustrated in FIG. 7, counter-current operation can be achieved when the orifices and collectors are suitably located on the short sides of the rectangular plates which make up the assembly. With relatively short exchangers, this would practically result in cross flow operation.

Figure 8:
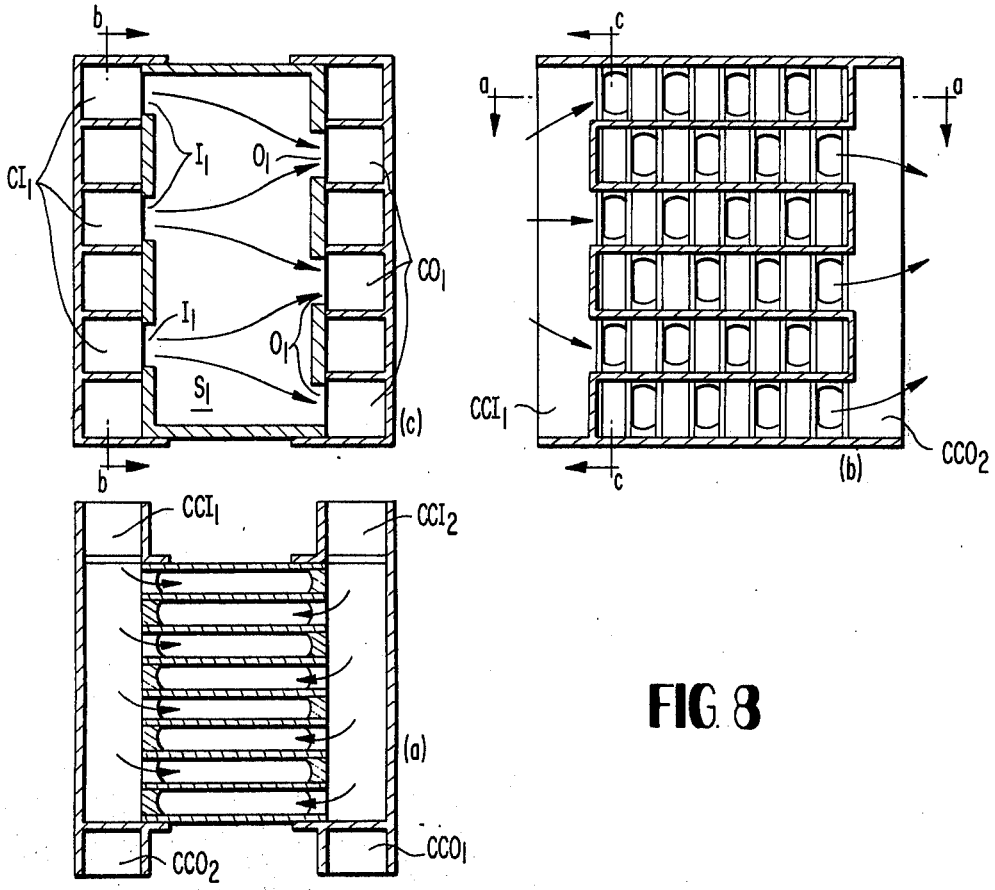
Figure 9:
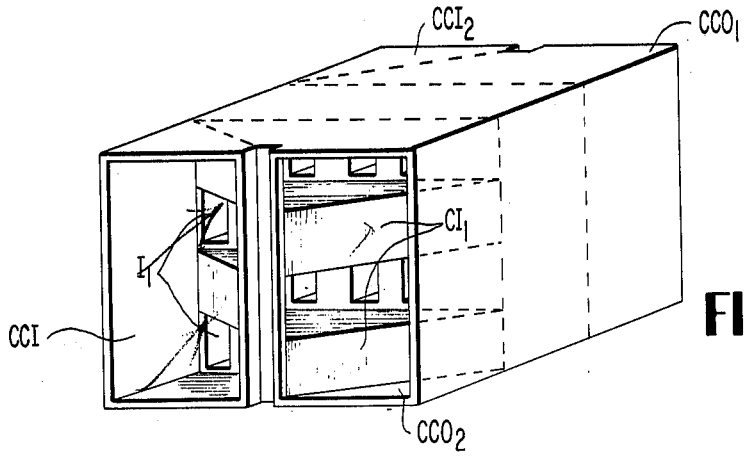

However, a counter current flow in relatively short bumped plate exchangers can be achieved by multiple collectors as illustrated in FIG. 8, representing some cross sections, and FIG. 9, giving a general view of such an heat exchanger with multiple collectors. One can see how any odd flow path $S_1$ for example has three inlet orifices $I_2$ and three outlet orifices $O_1$. Similarly, any even path $S_2$ has three inlet orifices $I_1$ and three outlets $O_2$. All of these orifices are located on two opposite faces of the plates assembly A, which constitutes the heat exchanger. Moreover, the orifices are arranged in such a way that the connected collectors are close together and alternating. This means that, for example, each $CI_1$ collector is next to or between $CO_2$ collectors and vice versa. The cross section (b) in FIG. 8 shows how for example one common zigzag shaped partition bounds both the inlet collectors $CI_1$ open to the left and the outlet collectors open to the right side. Obviously with this arrangement it is easy to arrange a general collector, for primary inlet $CCI_1$ connected with the three primary inlet collectors $CI_1$, and a general secondary outlet collector $CCO_2$ in connection with the aforesaid outlet collectors $CO_2$. This arrangement gives fair counter-current operation if the width of the collectors $CI_1$, $CO_2$, is relatively small as compared to the length of the flow path through the heat exchanging assembly.

FIG. 9 gives a general view of a plate heat exchanger with multiple collectors for counter-current operation. In this case, a constructive variation on the former example, using a zigzag shaped partition between the collectors, the folds of which are not parallel, allows in a simple and compact way the canalization of the fluids in such a way that the flow in the main inlets and outlets is parallel to the flow within any of the flow paths of the heat exchanging assembly A.

In practice the partial and systematic sealing of the periphery of the flow paths S in a plates assembly A as described above can be achieved in different ways.

Figure 4:
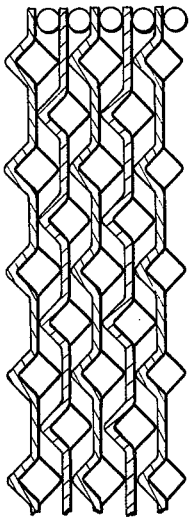
Figure 5:
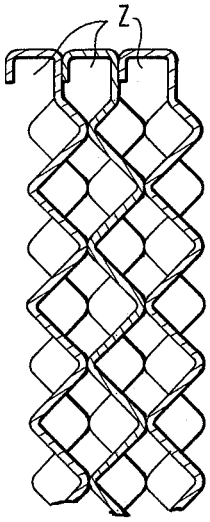
Figure 6A:
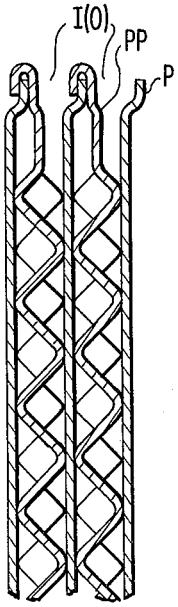

For example, one can clamp a wire with a suitable diameter between the successive plates, or fold the edges of the said plates in the zones to be stopped, and finish the job by brazing or dipping. Instead of the wire or the edge folding, one can clamp two consecutive plates located between two orifices to be connected to a common collector. These procedures are illustrated in FIGS. 4, 5 and 6a.

Figure 6B:
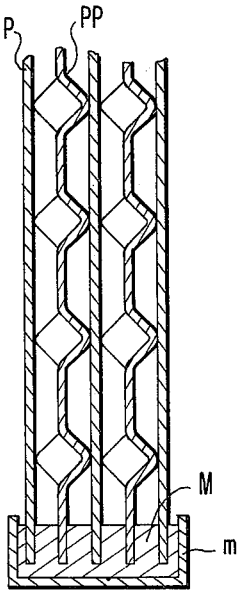
Figure 10:
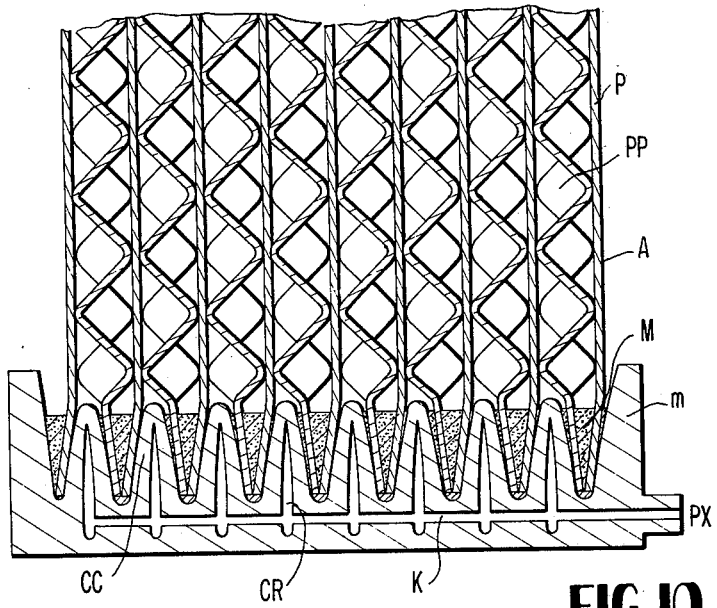
Figure 11:
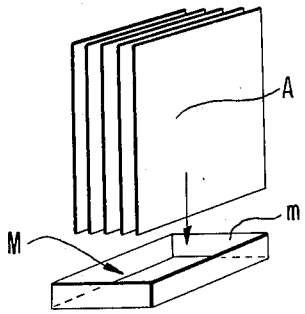

The FIGS. 10 and 11 illustrate another solution applicable in the zones where inlet and outlet orifices are wanted. In this case one does the reverse: provisional plugs C are put there where orifices I or O are wanted, possibly the edges of two plates in contact with each other are clamped, as shown in FIG. 6a. A face of the assembly A, completely prepared with provisional plugs, is put horizontally in an horizontal shallow mould m (see FIGS. 11, 6b) where a liquid mass M is poured, possibly on a reinforcing grid, the liquid solidifying by polymerisation or cooling, thus stopping and plugging the peripheral zones of the flow paths, submerged in the solidified mass M. By withdrawing the plugs C after unmolding, the necessary inlet and outlet orifices come free. Obviously the same operation of preparation and moulding is repeated for any of the four faces formed by the edges of the bumped plates which constitute the heat exchanger.

FIG. 10 illustrates an improved procedure. In this case the plugs CC have flexible walls and can be inflated during the moulding operation and thus be kept right in place. By deflating or by applying a vacuum, they can be removed easily during unmoulding after the mass M is solidified. Furthermore, one single flexible piece (made of, for example, moulded rubber) constitutes the mould m and incorporates any of the necessary plugs CC. These are in communication with a common pressure tap Px by means of a small integrated duct K. These improvements allow the acceleration of the preparation, moulding and unmoulding operations, resulting in higher precision.

The joining of consecutive plates in a zone where inlet or outlet orifices are wanted can also be done by dipping at a limited depth, the plate edges being shaped by pressing in order to touch each other (as shown in FIG. 16). If the dipping fluid (M) has suitable viscosity and surface tension, the plates in contact with each other will be bound. Where there is a fair gap between the plate edges, the orifices will stay free and open.

Another procedure involves spraying of a solidifying mass (M), possibly in different layers, the spraying gun being held in a plane perpendicular to the plates, at angles close to a right angle, as shown in FIG. 17, once from right to left, once in the opposite direction. It is easy to see how, depending on the spraying angle and the gap between plate couples, only a narrow strip on each of the plates will be covered. Gravity forces make the films of deposited deposited (with suitable viscosity and surface tension) join. In fact, by dipping or spraying as explained or by a combination of both, a U-shaped binding strip (U) is formed along the plates edges, as shown in FIG. 16, and 17. This will not be subject to "peeling", but rather to shear and traction forces when pressure differences are applied to a finished heat exchanger. Moreover, the spraying procedure allows the use of two component binding agents with a limited "pot life", with minimum material wastes.

Figure 1:
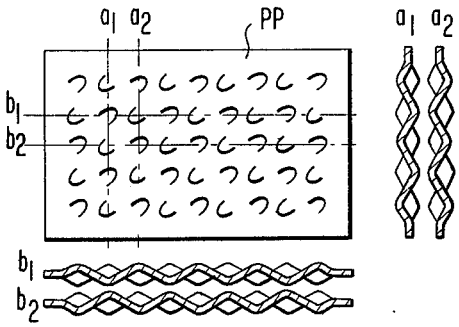
FIGS. 1 to 6 show some elements and details, whereas the FIGS. 7, 8 and 9 illustrate assembled heat exchangers. The FIGS. 10 and 11 are related to a particular way of assembling. Finally, the FIGS. 12 to 15 illustrate a special heat exchanger, whose bumped plates are made out of one single folded sheet.
Figure 2:
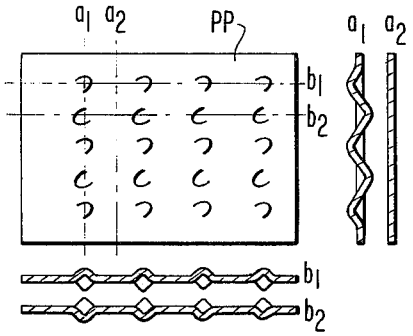
Figure 3:
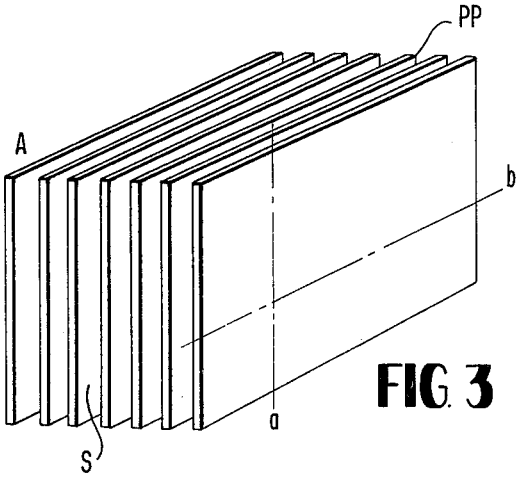

In some applications, heat exchangers have to support important fluid pressure differences under severe tightness conditions. In such cases the aforesaid manufacture procedures might fail. In some cases welding is necessary. For good rigidity and resistance, a particular bumping can be used which involves that each point of the originally flat plate is stretched, and after pressing, no straight or flat places subsist. To limit the total length of welded joints on the heat exchangers, one can make the plates PP, or P of the exchanger as a single seamless piece made from a long continuous suitably bumped strip of sheet material folded in zigzag as shown in FIG. 12. Each layer constitutes a plate P (or PP), two consecutive plates making a pocketlike flow path $S_1$ which is closed on the lower folding line. Using an even number of folds or plates with uniform width, one obtains a number of identical flow paths $S_1$ which all are closed on one side (downside in FIG. 12) and open on the opposite side (upside) and which together make a rectangular bumped plates assembly as described above (compare FIG. 3). With suitable bumping as explained with foregoing FIGS. 1 and 2 and folding up to the point where the consecutive folds touch each other by means of the bumps as explained with the foregoing FIGS. 4, 5 or 6, obviously an assembly of parallel plates results at uniform distances, between which fluids can circulate and spread in principle in any direction. This assembly obtained by suitable bumping and folding, can be completed as illustrated in FIG. 13 by a flat cover plate Py on the assembly's face *y* where originally the flow paths are open, the cover Py having inlet and outlet orifices $CI_1$ and $CO_1$ located at the extremities and sized in order to communicate with any of the pocket like flow paths $S_1$. The edge of the said cover Py is welded to the outer edges of the zigzag assembly. Moreover each couple of plates making a flow path $S_1$ is welded and tightened at the extremities. The latter joints can be made with cast metal somewhat according to FIG. 11 instead of welding.

In the way described with a relatively limited length of welded joints one obtains a hollow, tight and compact body X with a great outer surface. Through the orifices $CI_1$ and $CO_1$ a primary fluid can circulate inside. This body resists external pressure well, since the bumped plates support each other. For higher rigidity, one can for example decrease the distance between successive bumps.

FIG. 14 illustrates in cross-section a device comprising the structure shown in FIG. 13. As shown therein, a secondary fluid can in principle circulate in any direction through the flow paths $S_2$ (shown in FIG. 13) subsisting between two successive pocket like paths $S_1$. This secondary fluid can be guided by an envelope E fitting around the rectangular hollow body X and having suitable inlet and outlet orifices $CI_2$ and $CO_2$. An elongated cylindrical envelope E can be used for better resistance to high static pressure in the secondary fluid. This kind of heat exchanger performs very well as a refrigerant condensor, the refrigerant condensing in the cylindrical shell or envelope E, the cooling water circulating through the body X mounted inside the shell E. As can be seen in FIG. 14, the collectors $CI_1$ and $CO_1$ of the said body X are mounted through the shell E which has a gas inlet $CI_2$ located on the top and a condensate outlet $CO_2$ located on the bottom.

In other cases, for example liquid/liquid heat exchange under high pressure, one can use a design as illustrated in FIG. 15. In this example, a rectangular hollow body X as shown in FIG. 13 is mounted inside a cylindrical shell E, together with fillings R in the voids between E and X, in order to force the secondary fluid to circulate in the flow paths $S_2$ of the body X.

The fields of application for heat exchangers with bumped plates or folds, conforming to the present invention, are numerous and diverse. Some examples have been suggested and illustrated in FIGS. 14 and 15. Another application involves heat exchanges between low pressure gases in general, and more particularly heat recovery in ventilation and air conditioning systems. In the latter case, the aim is to exchange heat - or cold - between exhaust air and fresh air. Evaporative cooling in non saturated ambient air can be related to the aforesaid heat recovery. For heat recovery in ventilation plants the exhaust air (primary fluid) and the fresh air (secondary fluid) circulate in countercurrent through a bumped plates heat exchanger conforming to the present invention, with a suitable rectangular envelope to resist to the static pressures involved, which in general are very moderate.

Evaporative cooling can be achieved with a quite similar heat exchanger: ambient air to be cooled circulates as a primary fluid, preferably in counter-current to a secondary ambient air flow which has been, upstream of the heat exchanger, adiabatically saturated with liquid water, thus cooling down from the dry to the wet bulb temperature. The performance can be improved by injection of an excess of water in the secondary air. This liquid excess is carried with the air which thus can be resaturated along the flow paths in the heat exchanger and reach the outlet nearly saturated; this means that the air has a maximum enthalpy for the temperature involved. Premature segregation by gravitation can be avoided by suitable arrangements. For example, the heat exchanger can be mounted for vertical flow, the secondary air coming down. This arrangement maintains a good contact between air and water in the flow paths $S_2$; at the outlet excess water can be separated and recirculated.

Another solution is to have the heat exchanging surfaces in a horizontal position. In this case excess water can be carried as a fog, or flow on the horizontal surfaces, driven by the flowing air.

A new and very interesting application in air conditioning and ventilation plants is the combination in one single heat exchanger of heat recovery and evaporative cooling as explained above. Fresh outside air - which is warm in summer - circulates in counter-current with adiabatically sursaturated exhaust air. In a well balanced plant, the exhaust air is normally far from saturation, and it is often lower in temperature than outside. Thus heat recovery with supersaturation cooling can be very efficient. Obviously, in winter conditions the exhaust air should not be humidified for heat recovery. The change-over from one to another condition can be automatic.

Bumped plate heat exchangers conforming to the present invention have typical advantages.

As to thermal performance, a suitable bumping design causes turbulence in the fluid flow resulting in high heat transfer coefficients, thus reducing the required exchanging surfaces and outside dimensions. At the same time, the associated pressure drops are relatively small as only primary surfaces are involved, without spacers. On the other hand the inlet and outlet collectors are arranged in a simple way and give insignificant local pressure drops.

From a mechanical point of view the resistance and rigidity are inherently high, even with thin and poor quality sheet material, due to the multiple contact points between successive plates. In some cases one can, for example, use plastic film or impregnated paper.

In connection with the inherent rigidity of the bumped plates heat exchanger, it can be designed and built with very narrow gaps between plates and thus with small outside sizes.

As to economic aspects, it can be noticed that the manufacture is simple and cheap, even if a wide range of different units is produced, and thus a flexible sales program is possible. With relatively low first cost, one can expect important savings on running costs, for example in the case of heat recovery in A.C. plants. It is even quite possible that the investment for a heat exchanger for heat recovery will be balanced by the investment savings for heat and cold generators to feed the A.C. plant.

What we claim is:

1. A counter current heat exchanger comprising a plurality of spaced apart parallel plates having spacer means therebetween for separating said plates and for spreading the flow of fluid between said plates over the entire surface area of said plates, housing means completely closing the spaces between said plates along two opposed sides of said plates, said housing means defining a plurality of rows of spaced apertures between said plates along the other two opposed sides of said plates with the apertures in alternate rows being offset from each other, primary inlet and outlet collector means secured to said housing means and co-extensive with the sides of said housing means having said apertures, each of said collector means comprised of the one-piece zigzag shaped wall member with adjacent portions of said wall member being disposed at right angles to each other so that alternate portions of said wall members are parallel to each other, said parallel wall portions having identical triangular configurations disposed perpendicular to said plates between said apertures so that alternate spaces between said triangular plates communicate with the apertures in alternate rows and secondary inlet and outlet collector means being comprised of wall means surrounding said primary collector means and disposed perpendicular to said apertured sides of said housing means, each of said secondary collector means in conjunction with each primary collector means defining two plenum chambers each having a triangular cross-section on opposite sides of said primary collector means.

2. A counter current heat exchanger as set forth in claim 1, wherein said primary collector means includes walls which guide the flow of the circulating fluid in said collector means in a direction oblique to their flow between said plates.

* * * * *